US008381418B2

(12) United States Patent
Peyton

(10) Patent No.: US 8,381,418 B2
(45) Date of Patent: Feb. 26, 2013

(54) FLUID-FILLED CHAMBERS WITH TETHER ELEMENTS

(75) Inventor: Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 442 days.

(21) Appl. No.: 12/777,167

(22) Filed: May 10, 2010

(65) Prior Publication Data

US 2011/0271552 A1 Nov. 10, 2011

(51) Int. Cl.
*A43B 13/18* (2006.01)

(52) U.S. Cl. ..... 36/29; 36/35 B; 428/69

(58) Field of Classification Search ..... 36/3 R, 36/3 A, 3 B, 29, 35 B, 45; 428/69
See application file for complete search history.

(56) References Cited

U.S. PATENT DOCUMENTS

| | | | | |
|---|---|---|---|---|
| 3,253,355 | A | 5/1966 | Menken | |
| 3,984,926 | A | 10/1976 | Calderon | |
| 4,025,974 | A | 5/1977 | Lea et al. | |
| 4,183,156 | A | 1/1980 | Rudy | |
| 4,219,945 | A | 9/1980 | Rudy | |
| 4,287,250 | A | 9/1981 | Rudy | |
| 4,340,626 | A | 7/1982 | Rudy | |
| 4,513,449 | A | 4/1985 | Donzis | |
| 4,619,055 | A | 10/1986 | Davidson | |
| 4,874,640 | A | 10/1989 | Donzis | |
| 4,906,502 | A | 3/1990 | Rudy | |
| 4,936,029 | A | 6/1990 | Rudy | |
| 5,042,176 | A | 8/1991 | Rudy | |
| 5,083,361 | A | 1/1992 | Rudy | |
| 5,134,790 | A | 8/1992 | Woitschaetzke et al. | |
| 5,369,896 | A | 12/1994 | Frachey et al. | |
| 5,543,194 | A * | 8/1996 | Rudy | 428/69 |
| 5,572,804 | A | 11/1996 | Skaja et al. | |
| 5,630,237 | A | 5/1997 | Ku | |
| 5,713,141 | A | 2/1998 | Mitchell et al. | |
| 5,741,568 | A | 4/1998 | Rudy | |
| 5,802,739 | A | 9/1998 | Potter et al. | |
| 5,918,383 | A | 7/1999 | Chee | |
| 5,952,065 | A | 9/1999 | Mitchell et al. | |
| 5,987,781 | A | 11/1999 | Pavesi et al. | |
| 5,993,585 | A | 11/1999 | Goodwin et al. | |

(Continued)

FOREIGN PATENT DOCUMENTS

| | | |
|---|---|---|
| EP | 1929893 | 6/2008 |
| WO | WO2004105530 | 12/2004 |

OTHER PUBLICATIONS

International Search Report and Written Opinion in PCT Application No. PCT/US2011/031626, mailed on Sep. 23, 2011.

*Primary Examiner* — Marie Patterson
(74) *Attorney, Agent, or Firm* — Plumsea Law Group, LLC

(57) ABSTRACT

A chamber may have an outer barrier and a tensile member. The barrier is formed from a polymer material that defines an interior cavity. The tensile member is located within the interior cavity and includes (a) a first layer element secured to the barrier, (b) a second layer element secured to an opposite portion of the barrier, and (c) a plurality of I-shaped tether elements that extend through the first layer element and the second layer element. In some configurations, the tether elements may include (a) a first end member located between the barrier and the first layer element, (b) a second end member located between the barrier and the second layer element, and (c) a central member extending through the first layer element and the second layer element and secured to the first end member and the second end member.

25 Claims, 16 Drawing Sheets

U.S. PATENT DOCUMENTS

| | | | | |
|---|---|---|---|---|
| 6,013,340 | A | 1/2000 | Bonk et al. | |
| 6,029,962 | A | 2/2000 | Shorten et al. | |
| 6,041,521 | A | 3/2000 | Wong | |
| 6,082,025 | A | 7/2000 | Bonk et al. | |
| 6,098,313 | A | 8/2000 | Skaja | |
| 6,119,371 | A | 9/2000 | Goodwin et al. | |
| 6,127,010 | A | 10/2000 | Rudy | |
| 6,127,026 | A | 10/2000 | Bonk et al. | |
| 6,203,868 | B1 | 3/2001 | Bonk et al. | |
| 6,205,682 | B1 * | 3/2001 | Park | 36/29 |
| 6,321,465 | B1 | 11/2001 | Bonk et al. | |
| 6,385,864 | B1 | 5/2002 | Sell, Jr. et al. | |
| 6,837,951 | B2 | 1/2005 | Rapaport | |
| 7,076,891 | B2 * | 7/2006 | Goodwin | 36/29 |
| 7,131,218 | B2 | 11/2006 | Schindler | |
| 7,386,946 | B2 * | 6/2008 | Goodwin | 36/29 |
| 7,555,851 | B2 * | 7/2009 | Hazenberg et al. | 36/102 |
| 7,588,654 | B2 * | 9/2009 | Schindler et al. | 156/147 |
| 7,591,919 | B2 * | 9/2009 | Schindler et al. | 156/147 |
| 8,151,486 | B2 * | 4/2012 | Dua | 36/29 |
| 8,241,451 | B2 * | 8/2012 | Rapaport et al. | 156/145 |
| 2002/0121031 | A1 | 9/2002 | Smith et al. | |
| 2003/0097767 | A1 | 5/2003 | Perkinson | |
| 2004/0055180 | A1 | 3/2004 | Manz | |
| 2005/0039346 | A1 | 2/2005 | Thomas et al. | |
| 2005/0097777 | A1 | 5/2005 | Goodwin | |
| 2005/0183287 | A1 * | 8/2005 | Schindler | 36/29 |
| 2006/0225304 | A1 * | 10/2006 | Goodwin | 36/35 B |
| 2007/0169379 | A1 | 7/2007 | Hazenberg et al. | |
| 2009/0288312 | A1 * | 11/2009 | Dua | 36/29 |
| 2009/0288313 | A1 * | 11/2009 | Rapaport et al. | 36/29 |

* cited by examiner

FLUID-FILLED CHAMBERS WITH TETHER ELEMENTS

BACKGROUND

Articles of footwear generally include two primary elements, an upper and a sole structure. The upper is formed from a variety of material elements (e.g., textiles, foam, leather, and synthetic leather) that are stitched or adhesively bonded together to form a void on the interior of the footwear for comfortably and securely receiving a foot. More particularly, the upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear.

The sole structure is located adjacent to a lower portion of the upper and is generally positioned between the foot and the ground. In many articles of footwear, including athletic footwear, the sole structure conventionally incorporates an insole, a midsole, and an outsole. The insole is a thin compressible member located within the void and adjacent to a lower surface of the void to enhance footwear comfort. The midsole, which may be secured to a lower surface of the upper and extends downward from the upper, forms a middle layer of the sole structure. In addition to attenuating ground reaction forces (i.e., providing cushioning for the foot), the midsole may limit foot motions or impart stability, for example. The outsole, which may be secured to a lower surface of the midsole, forms the ground-contacting portion of the footwear and is usually fashioned from a durable and wear-resistant material that includes texturing to improve traction.

The conventional midsole is primarily formed from a foamed polymer material, such as polyurethane or ethylvinylacetate, that extends throughout a length and width of the footwear. In some articles of footwear, the midsole may include a variety of additional footwear elements that enhance the comfort or performance of the footwear, including plates, moderators, fluid-filled chambers, lasting elements, or motion control members. In some configurations, any of these additional footwear elements may be located between the midsole and either of the upper and outsole, embedded within the midsole, or encapsulated by the foamed polymer material of the midsole, for example. Although many conventional midsoles are primarily formed from a foamed polymer material, fluid-filled chambers or other non-foam structures may form a majority of some midsole configurations.

SUMMARY

A chamber is disclosed below as including an outer barrier and a tensile member. The outer barrier is formed from a polymer material that is sealed to define an interior cavity for enclosing a pressurized fluid. The tensile member is located within the interior cavity and includes a plurality of I-shaped tether elements that extend across the cavity.

An article of footwear is disclosed below as having an upper and a sole structure secured to the upper. At least one of the upper and the sole structure incorporates a chamber with an outer barrier and a tensile member. The outer barrier is formed from a polymer material that defines an interior cavity, and the barrier includes (a) a first barrier portion that forms a first surface of the chamber and (b) a second barrier portion that forms an opposite second surface of the chamber. The tensile member is located within the interior cavity of the outer barrier and includes (a) a first layer element secured to the first barrier portion of the outer barrier, (b) a second layer element secured to the second barrier portion of the outer barrier, and (c) a plurality of I-shaped tether elements that extend through the first layer element and the second layer element.

In some configurations the footwear, or the chamber, the tether elements may include (a) a first end member located between the first barrier portion and the first layer element, (b) a second end member located between the second barrier portion and the second layer element, and (c) a central member extending through the first layer element and the second layer element and secured to the first end member and the second end member.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose an article of footwear, as well as various fluid-filled chambers that may be incorporated into the footwear. Concepts related to the chambers are disclosed with reference to footwear that is suitable for running. The chambers are not limited to footwear designed for running, however, and may be utilized with a wide range of athletic footwear styles, including basketball shoes, cross-training shoes, cycling shoes, football shoes, soccer shoes, tennis shoes, and walking shoes, for example. The chambers may also be utilized with footwear styles that are generally considered to be non-athletic, including dress shoes, loafers, sandals, and boots. The concepts disclosed herein may, therefore, apply to a wide variety of footwear styles, in addition to the specific style discussed in the following material and depicted in the accompanying figures. The chambers may also be utilized with a variety of other products, including backpack straps, mats for yoga, seat cushions, and protective apparel, for example.

General Footwear Structure

Figure 1:
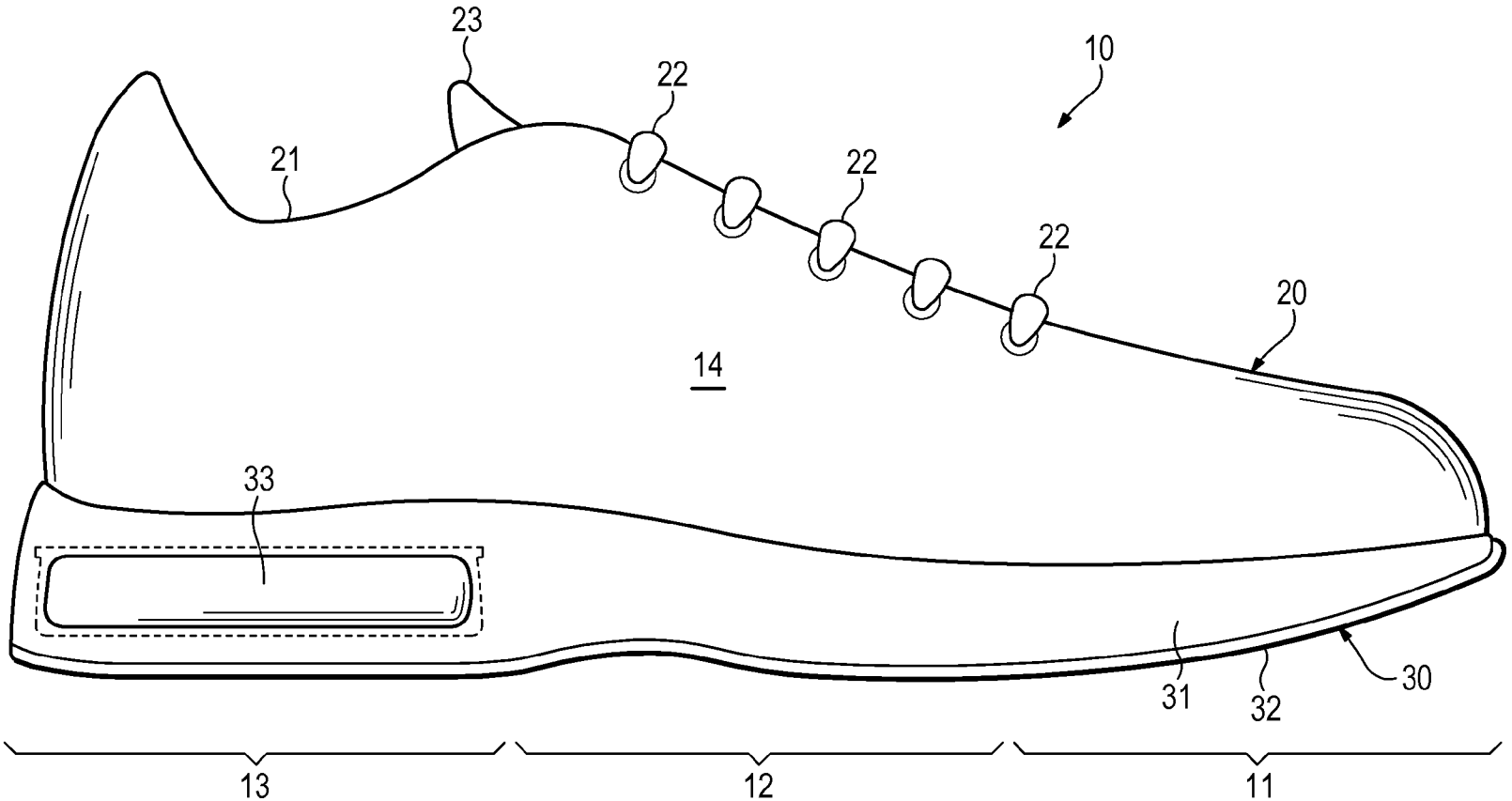
FIG. 1 is a lateral side elevational view of an article of footwear.
Figure 2:
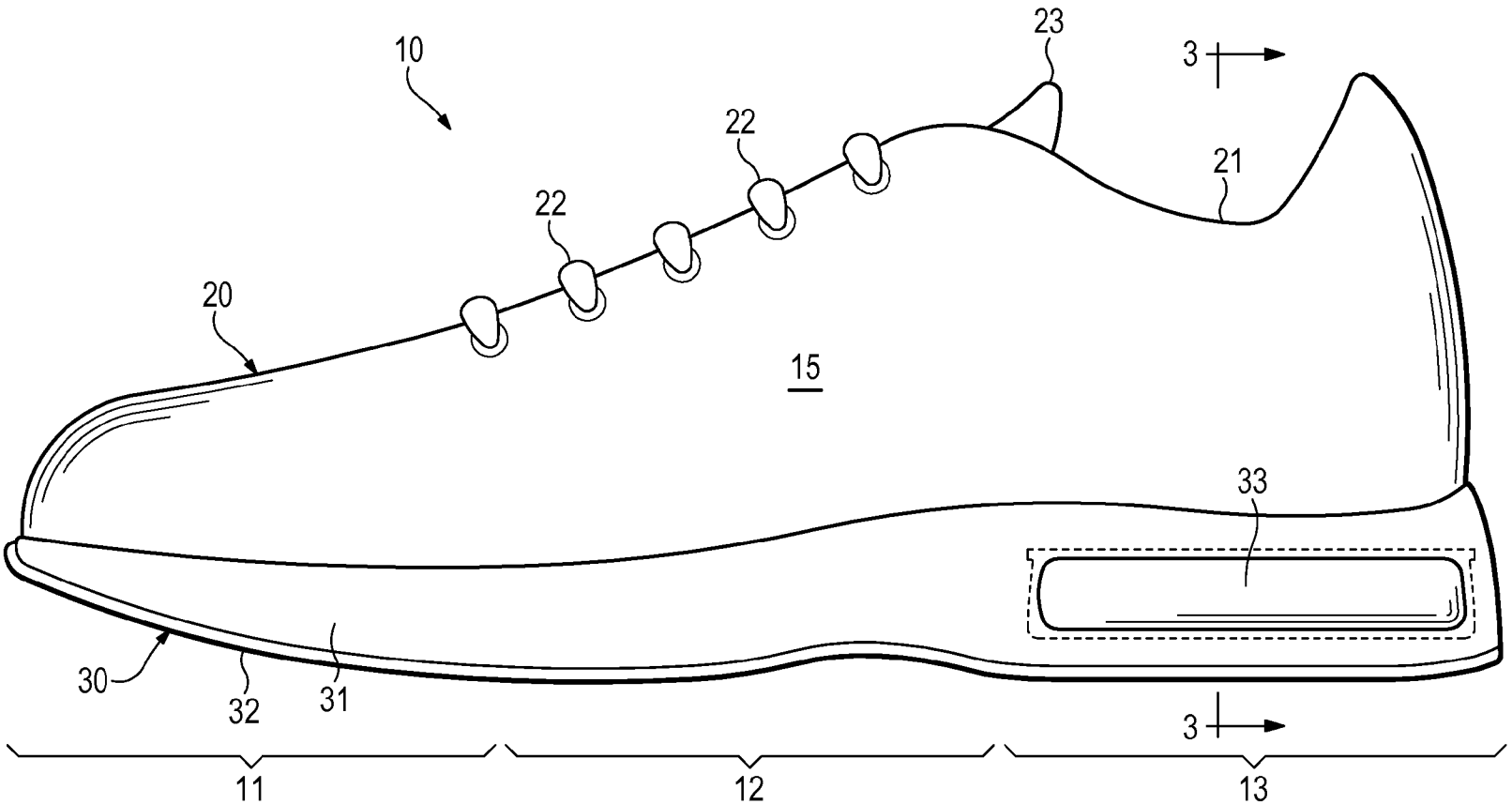
FIG. 2 is a medial side elevational view of the article of footwear.
Figure 3:
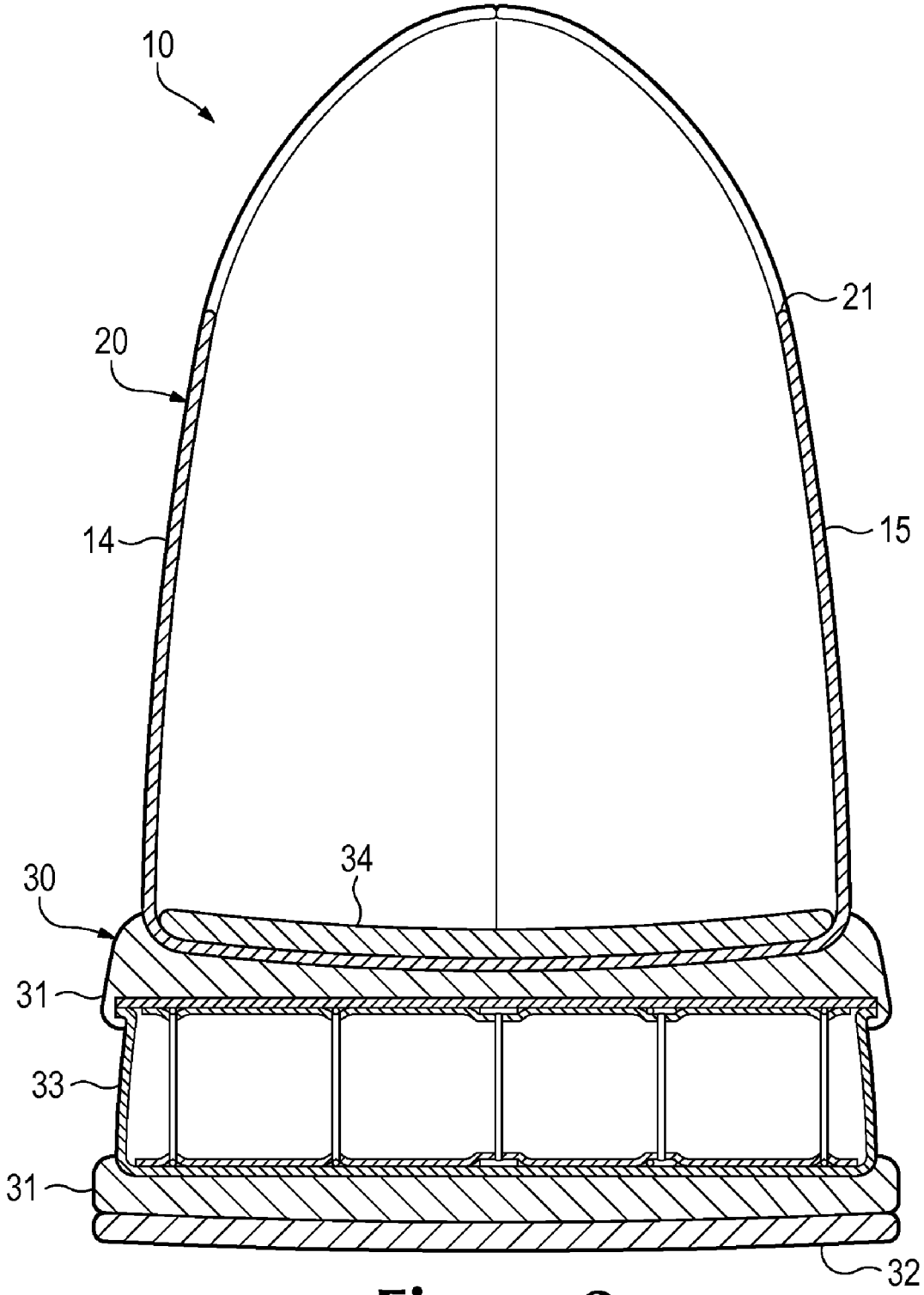
FIG. 3 is a cross-sectional view of the article of footwear, as defined by section line 3-3 in FIG. 2.
Figure 4:
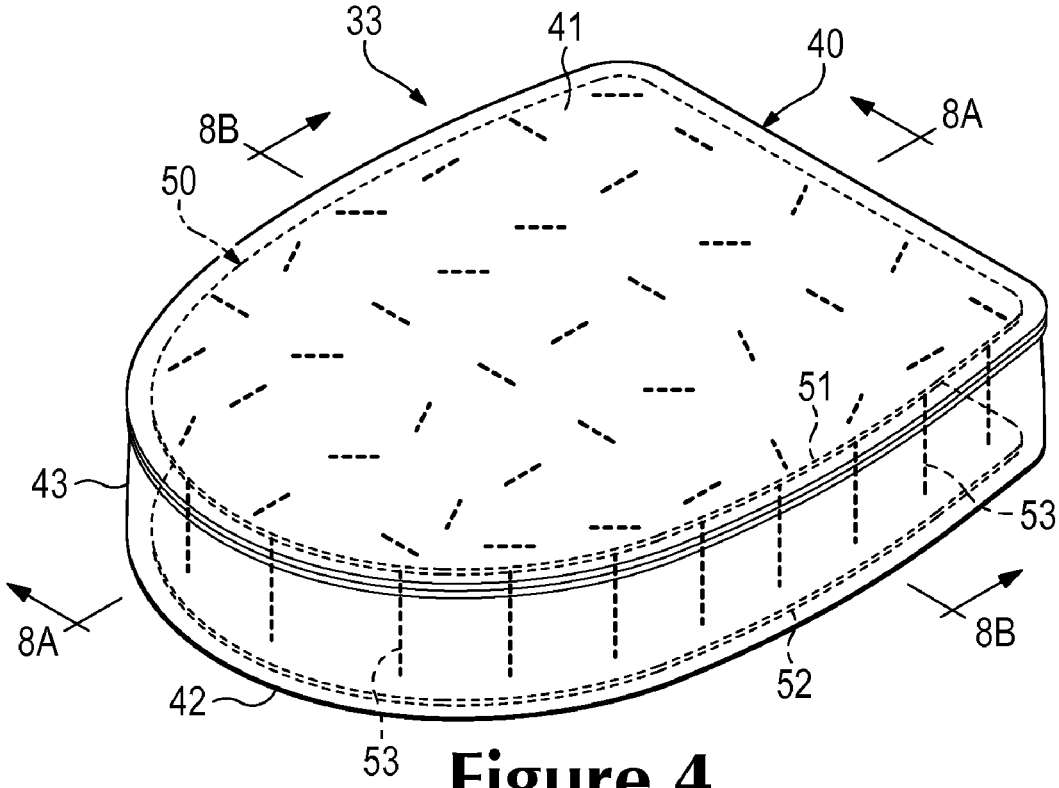
FIG. 4 is a perspective view of a chamber from the article of footwear.
Figure 5:
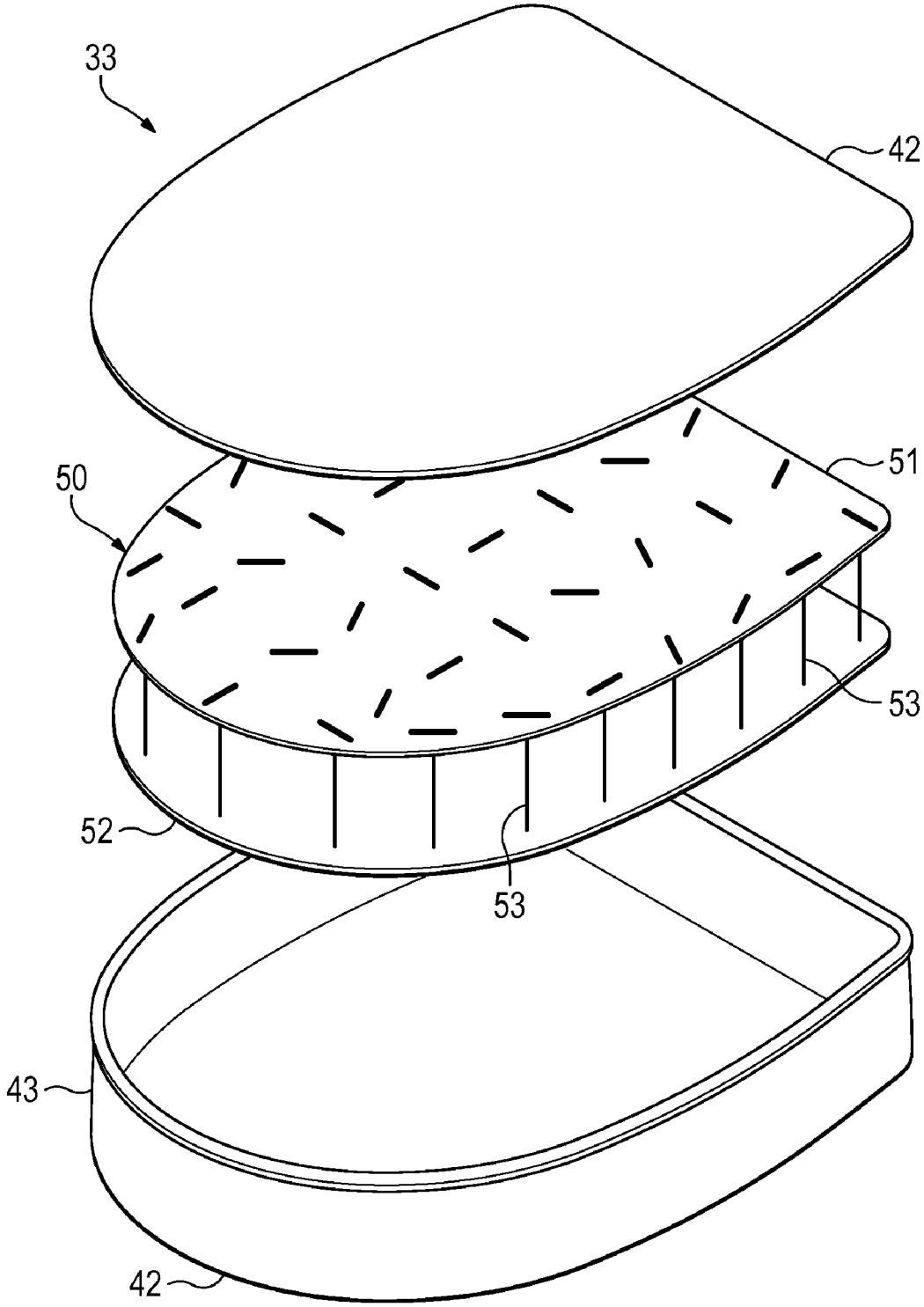
FIG. 5 is an exploded perspective view of the chamber.
Figure 6:
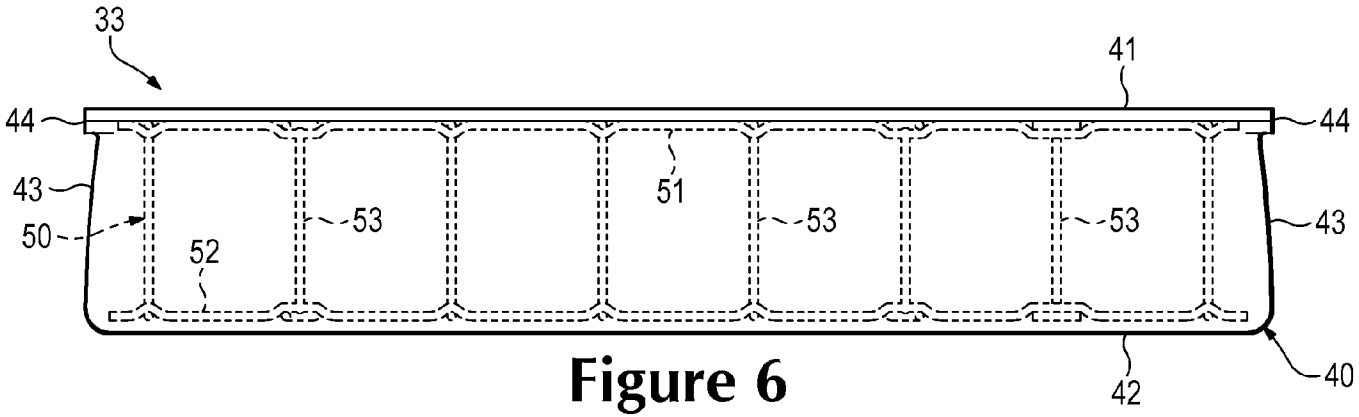
FIG. 6 is a side elevational view of the chamber.
Figure 7:
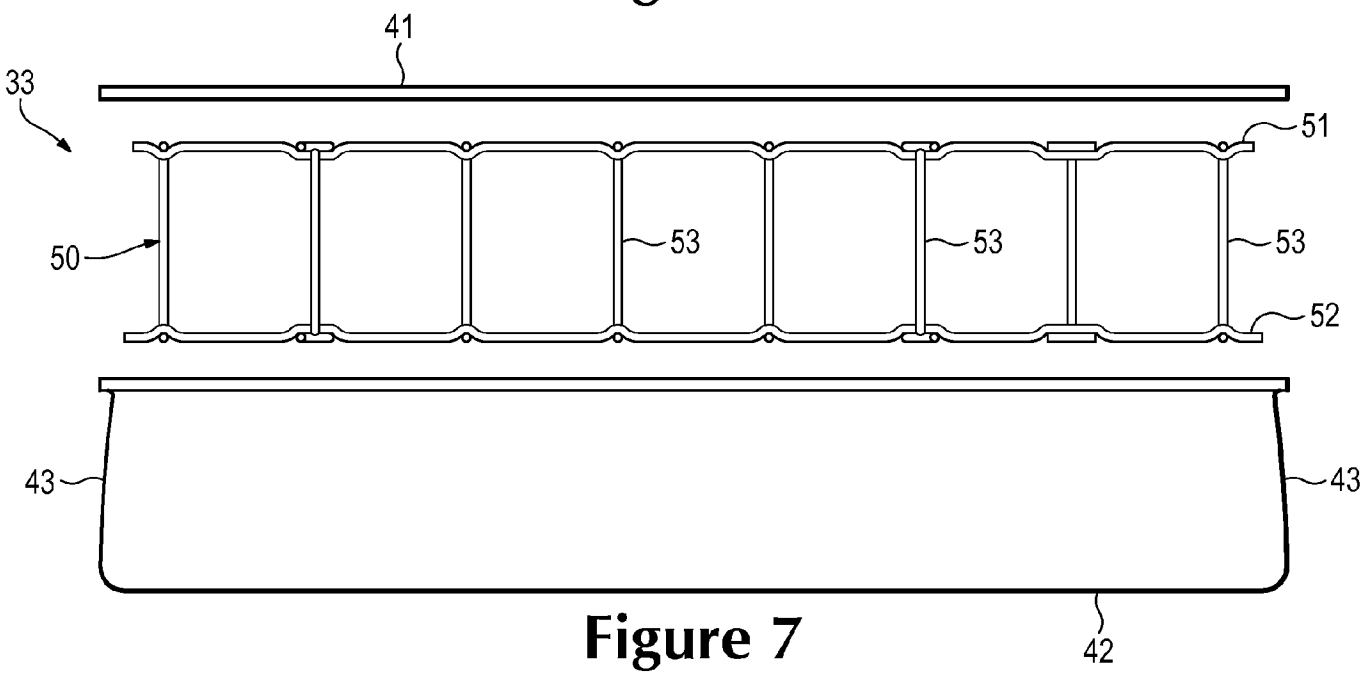
FIG. 7 is an exploded side elevational view of the chamber.

An article of footwear 10 is depicted in FIGS. 1-3 as including an upper 20 and a sole structure 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration incorporating a plurality material elements (e.g., textiles, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that extends through apertures in upper 20 and is utilized in a conventional manner to modify the dimensions of the interior void, thereby securing the foot within the interior void and facilitating entry and removal of the foot from the interior void. A tongue 23 of upper 20 also extends along a throat area of upper 20 and between the interior void and lace 22. Given that various aspects of the present discussion primarily relate to sole structure 30, upper 20 may exhibit the general configuration discussed above or the general configuration of practically any other conventional or non-conventional upper. Accordingly, the structure of upper 20 may vary significantly within the scope of the present invention.

Sole structure 30 is secured to upper 20 and has a configuration that extends between upper 20 and the ground. In addition to attenuating ground reaction forces (i.e., providing cushioning for the foot), sole structure 30 may provide traction, impart stability, and limit various foot motions, such as pronation. The primary elements of sole structure 30 are a midsole element 31, an outsole 32, and a chamber 33. Midsole element 31 is secured to a lower area of upper 20 and may be formed from various polymer foam materials (e.g., polyurethane or ethylvinylacetate foam) that extend through each of regions 11-13 and between sides 14 and 15. Additionally, midsole element 31 at least partially envelops or receives chamber 33, which will be discussed in greater detail below. Outsole 32 is secured to a lower surface of midsole element 31 and may be formed from a textured, durable, and wear-resistant material (e.g., rubber) that forms the ground-contacting portion of footwear 10. In addition to midsole element 31, outsole 32, and chamber 33, sole structure 30 may incorporate one or more support members, moderators, or reinforcing structures, for example, that further enhance the ground reaction force attenuation characteristics of sole structure 30 or the performance properties of footwear 10. Sole structure 30 may also incorporate a sockliner 34, as depicted in FIG. 3, that is located within a lower portion of the void in upper 20 and is positioned to contact a plantar (i.e., lower) surface of the foot to enhance the comfort of footwear 10.

When incorporated into sole structure 30, chamber 33 has a shape that fits within a perimeter of midsole element 31 and extends through heel region 13 and also extends from lateral side 14 to medial side 15. Although chamber 33 is depicted as being exposed through the polymer foam material of midsole element 31, chamber 33 may be entirely encapsulated within midsole element 31 in some configurations of footwear 10. When the foot is located within upper 20, chamber 33 extends under a heel area of the foot in order to attenuate ground reaction forces that are generated when sole structure 30 is compressed between the foot and the ground during various ambulatory activities, such as running and walking. In some configurations, chamber 33 may protrude outward from midsole element 31, extend into midfoot region 12, or extend forward to forefoot region 11. Accordingly, the shape and dimensions of chamber 33 may vary significantly to extend through various areas of footwear 10.

Chamber Configuration

Chamber 33 is depicted separate from a remainder of footwear 10 in FIGS. 4-8B and includes a barrier 40 and a tensile member 50. In general, barrier 40 is formed from a polymer material that (a) forms an exterior surface of chamber 33, (b) defines an interior cavity that receives both a pressurized fluid and tensile member 50, and (c) provides a durable and sealed barrier for retaining the pressurized fluid within chamber 33. Tensile member 50 is located within the interior cavity of barrier 40 and is secured to an interior surface of barrier 40 (i.e., the surface defining the interior cavity). The pressurized fluid within barrier 40 tends to place an outward force upon barrier 40. Tensile member 50, however, restrains the outward force of the pressurized fluid, thereby retaining an intended shape of chamber 33.

Barrier 40 is formed from a polymer material that defines a first or upper barrier portion 41, an opposite second or lower barrier portion 42, and a sidewall barrier portion 43. Upper barrier portion 41 forms a first or upper surface or chamber 33, as well as a portion of the interior surface of barrier 40 to which tensile member 50 is secured. Similarly, lower barrier portion 42 forms a second or lower surface or chamber 33, as well as another portion of the interior surface of barrier 40 to which tensile member 50 is secured. Sidewall barrier portion 43 extends between barrier portions 41 and 42 around a periphery of chamber 33. Accordingly, barrier 40 provides a sealed outer barrier for chamber 33 that defines an interior cavity for enclosing the pressurized fluid and receiving tensile member 50.

Although barrier 40 may be formed through a variety of processes, which each impart different characteristics to barrier 40, a thermoforming process may be utilized to (a) form upper barrier portion 41 from a first sheet of thermoplastic polymer material, (b) form lower barrier portion 42 and sidewall barrier portion 43 from a second sheet of thermoplastic polymer material, and (c) form a peripheral bond 44 that extends around barrier 40 and joins the sheets of thermoplastic polymer material. Although peripheral bond 44 is depicted as being at an elevation of an upper surface of chamber 33, peripheral bond 44 may be centered between the upper and lower surfaces, or peripheral bond may be at an elevation of the lower surface. When some blowmolding processes are utilized to form barrier 40, a parting line may replace peripheral bond 44, or peripheral bond 44 may be absent from chamber 33.

A wide range of polymer materials may be utilized for barrier 40, both thermoplastic and thermoset. In selecting materials for barrier 40, engineering properties of the material (e.g., tensile strength, stretch properties, flex properties, fatigue characteristics, dynamic modulus, and loss tangent) as well as the ability of the material to prevent the diffusion of the fluid contained by barrier 40 may be considered. Examples of polymer materials that may be suitable for barrier 40 include polyurethane, urethane, polyester, polyester polyurethane, and polyether polyurethane. Barrier 40 may also be formed from a material that includes alternating layers of thermoplastic polyurethane and ethylene-vinyl alcohol copolymer, as disclosed in U.S. Pat. Nos. 5,713,141 and 5,952,065 to Mitchell, et al. Another suitable material for barrier 40 is a flexible microlayer membrane that includes alternating layers of a gas barrier material and an elastomeric material, as disclosed in U.S. Pat. Nos. 6,082,025 and 6,127,026 to Bonk, et al. Additional suitable materials are disclosed in U.S. Pat. Nos. 4,183,156 and 4,219,945 to Rudy. Further suitable materials include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340; 6,203,868; and 6,321,465 to Bonk, et al.

The fluid within barrier 40 (i.e., within chamber 33) may be pressurized between zero and three-hundred-fifty kilopascals (i.e., approximately fifty-one pounds per square inch) or more. In addition to air and nitrogen, the fluid may include any of the gasses disclosed in U.S. Pat. No. 4,340,626 to Rudy. In some configurations, chamber 33 may incorporate a valve or other structure that permits the wearer or another individual to adjust the pressure of the fluid.

Tensile member 50, as discussed above, is located within the interior cavity formed by barrier 40 and is secured to the interior surface of barrier 40. Moreover, tensile member 50 extends across the interior cavity to effectively join opposite sides of barrier 40. Given that tensile member 50 is secured to barrier 50 and extends across the interior cavity, the pressurized fluid placing an outward force upon barrier 40 also places tensile member 50 in tension. Given that tensile member 50 has a non-stretch configuration or stretches to a relatively small degree, tensile member 50 effectively restrains the outward force of the pressurized fluid, thereby retaining the intended shape of chamber 33.

The primary components of tensile member 50 are a first or upper layer element 51, an opposite second or lower layer element 52, and a plurality of tether elements 53 that extend between and join layer elements 51 and 52. Whereas upper layer element 51 is secured to the inner surface formed by upper barrier portion 41, lower layer element 52 is secured to the inner surface formed by lower barrier portion 42. Either adhesive bonding or thermobonding, for example, may be utilized to secure tensile member 50 to barrier 40. Tether elements 53 extend through each of layer elements 51 and 52 to form restraining members that extend across the interior cavity. That is, tether elements 53 space layer elements 51 and 52 apart from each other. Moreover, the outward force of the pressurized fluid places tether elements 53 in tension.

Layer elements 51 and 52 are formed, for example, from either a textile or a polymer sheet. In general, layer elements 51 and 52 may be formed from any two-dimensional material, which encompasses generally flat materials exhibiting a length and a width that are substantially greater than a thickness. Accordingly, suitable materials for base layer 41 include various textiles, polymer sheets, combinations of textiles and polymer sheets, or plates, for example. Layer elements 51 and 52 may also be formed from laminated or otherwise layered materials that include two or more layers of textiles, polymer sheets, or combinations of textiles and polymer sheets. Although layer elements 51 and 52 may have smooth or generally untextured surfaces, some configurations may exhibit textures or other surface characteristics, such as dimpling, protrusions, ribs, or various patterns, for example. As noted above, thermobonding may be utilized to secure tensile member 50 to barrier 40. In this scenario, layer elements 51 and 52 may incorporate a thermoplastic polymer material (e.g., a thermoplastic polymer sheet or textile integrating a thermoplastic polymer sheet or material) that facilitates thermobonding.

Figure 9:
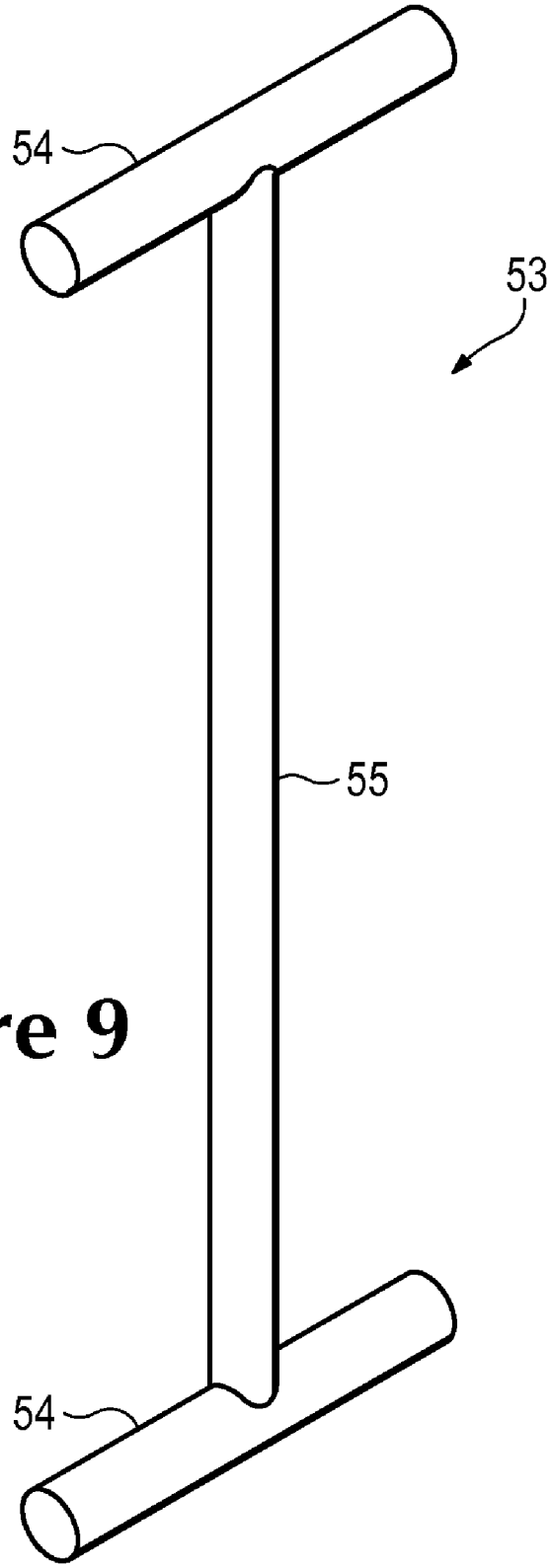
FIG. 9 is a perspective view of a tether element of the chamber.

One of tether elements 53 is depicted in FIG. 9 as having an I-shaped configuration that includes a pair of end members 54 and a central member 55 that is joined to end members 54 (e.g., joined to a central area of each of end members 54). In general, tether elements 53 may have the configuration of a hang tag (i.e., clothing tags, security tags, tag pins, or fabric fasteners) that is utilized to join price tags and other information to apparel and other products in a retail environment. As such, end members 54 and central member 55 may be molded or otherwise formed of unitary (i.e., one-piece) construction from a polymer material, such as nylon, polypropylene, or polyethylene, for example. In some configurations, end members 54 and central member 55 may each have a cylindrical structure, but a variety of other structures may also be utilized. Some other fluid-filled chambers for footwear and other products (e.g., see U.S. Patent Application Publication Number 2009/0288313 to Rapaport, et al.) incorporate a spacer textile material as a tensile member. In comparison with the spacer textile material, tensile member 50 may be more efficient to produce and may exhibit enhanced customizability (e.g., thickness, contouring, stability).

Figure 8A:
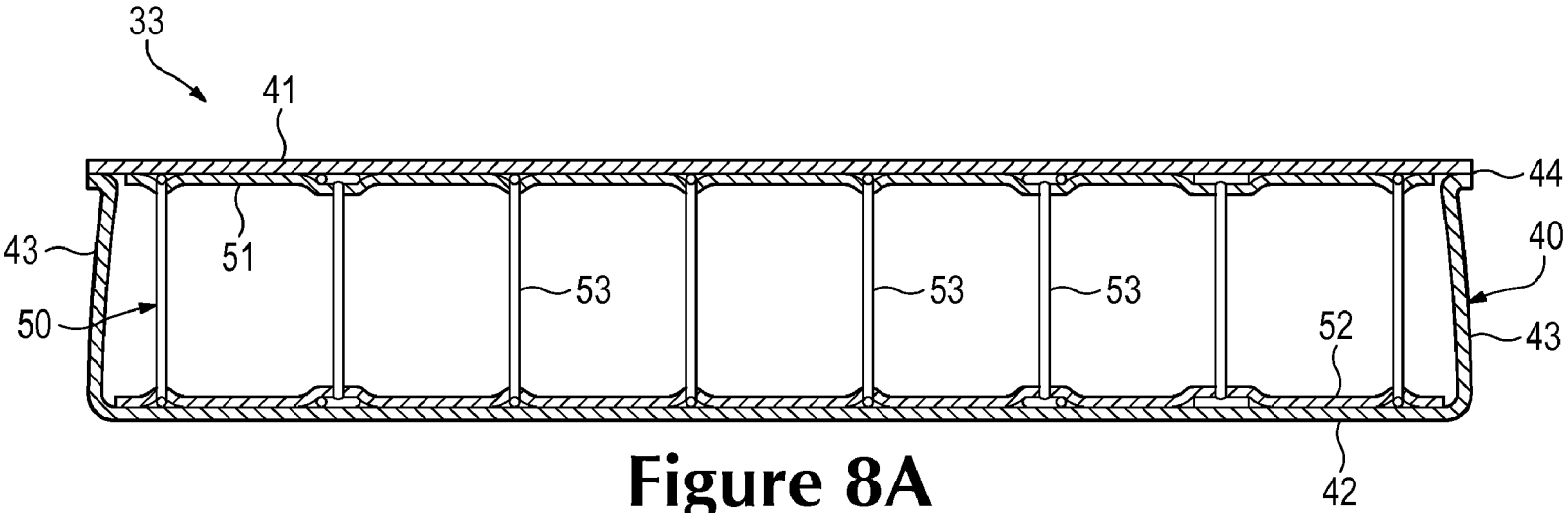
FIGS. 8A and 8B are cross-sectional views of the chamber, as defined by section lines 8A and 8B in FIG. 4.
Figure 8B:
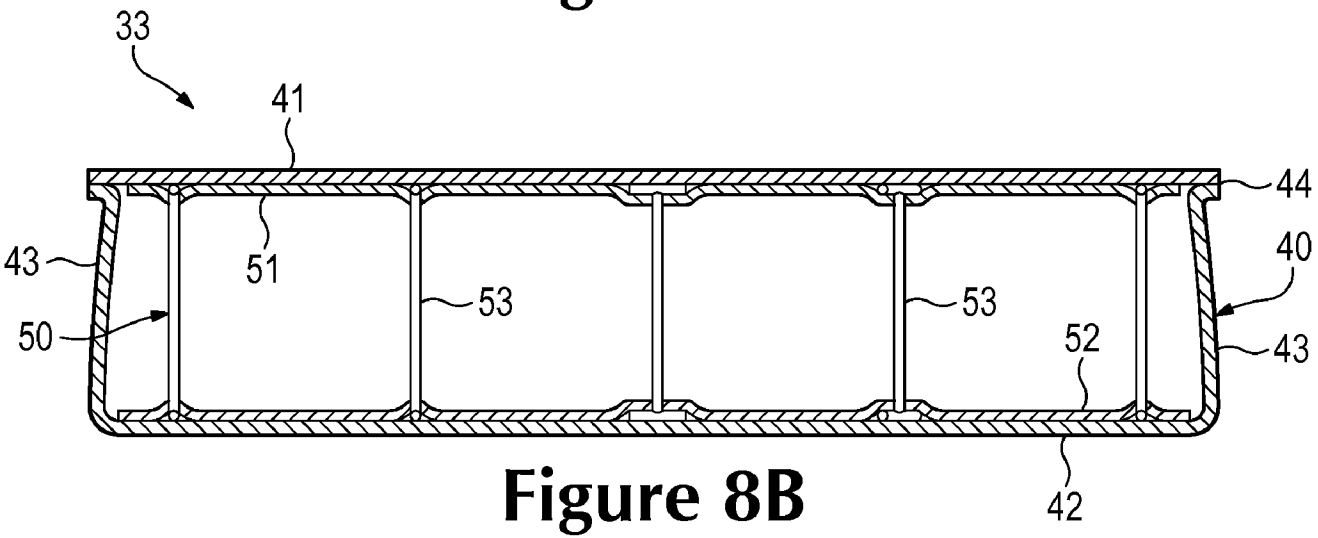

Tether elements 53 are arranged in rows that extend longitudinally along the lengths of layer elements 51 and 52. Referring to FIG. 8A, one of the rows includes eight tether elements 53. Tether elements 53 are also arranged in columns that extend across layer elements 51 and 52. Referring to FIG. 8B, one of the columns includes five tether elements 53. Although tether elements 53 are each depicted as having the same lengths and a substantially vertical orientation, the lengths and orientation of tether elements 53 may vary, as discussed in greater detail below.

Within tensile member 50, tether elements 53 extend through each of layer elements 51 and 52. More particularly, (a) one of end members 54 is located between upper barrier portion 41 and first layer element 51, (b) the other of end members 54 is located between lower barrier portion 42 and lower layer element 52, and (c) central member 55 extends through upper layer element 51 and lower layer element 52. In this configuration, end members 54 are restrained from pulling through or otherwise passing through layer elements 51 and 52 when central member 55 is placed in tension due to the outward force upon barrier portions 41 and 42 from the pressurized fluid. Accordingly, the I-shaped configuration ensures that tether elements 53 remain positioned relative to layer elements 51 and 52 when the pressurized fluid places portions of tether elements 53 in tension.

As a summary, chamber 33 includes both barrier 40 and tensile member 50. Barrier 40 is formed from a polymer material that defines an interior cavity, and the barrier includes (a) first or upper barrier portion 41, which forms a first surface of chamber 33 and (b) second or lower barrier portion 42, which forms an opposite second surface of chamber 33. Tensile member 50 is located within the interior cavity of barrier 40 and includes (a) first or upper layer element 51, which is secured to upper barrier portion 41, (b) second or lower layer element 52, which is secured to lower barrier portion 42, and (c) the plurality of I-shaped tether elements 53, which extend through layer elements 51 and 52.

Further Chamber Configurations

Figure 10A:
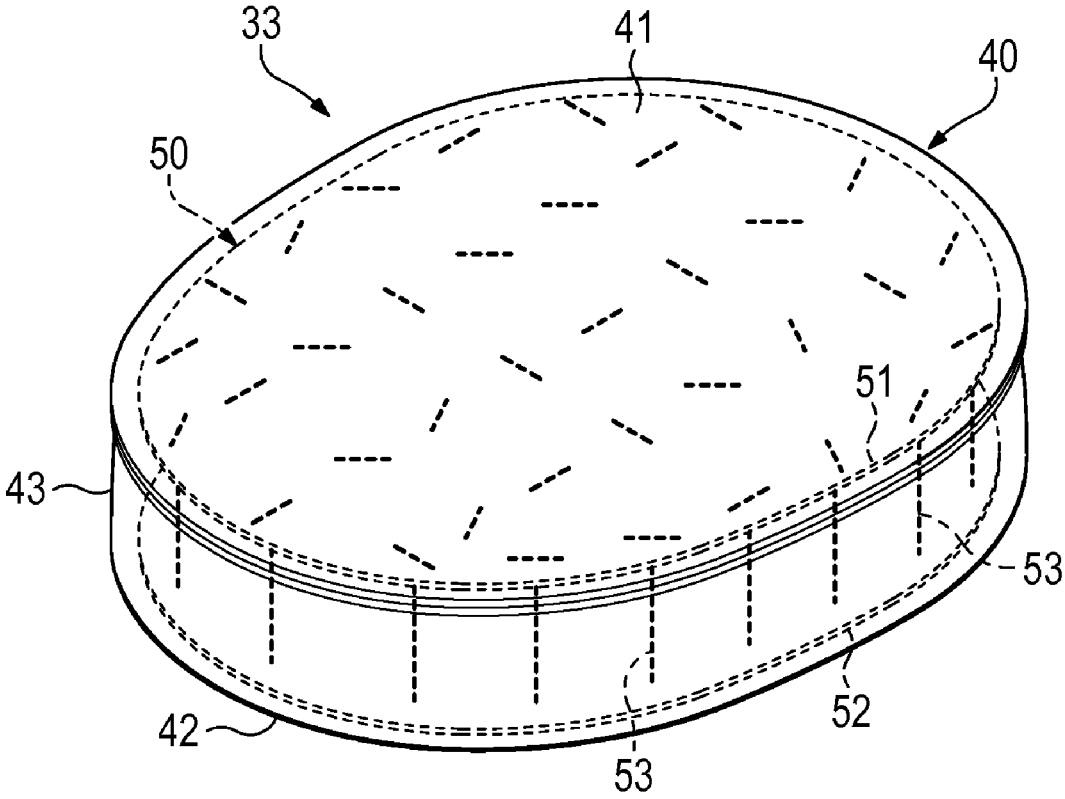
FIGS. 10A-10C are perspective views depicting further configurations of the chamber.
Figure 10B:
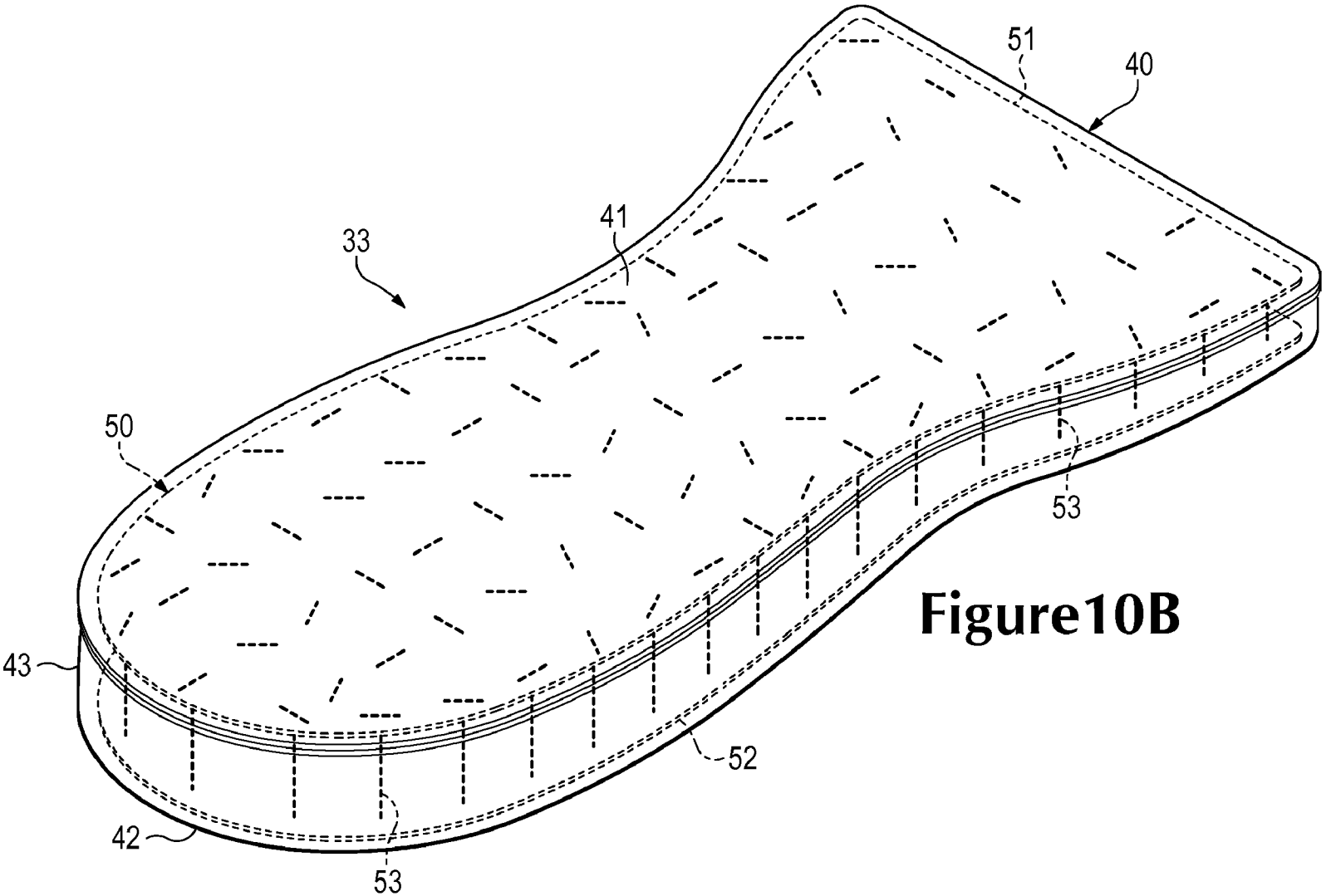

The overall configuration of chamber 33, including barrier 40 and tensile member 50, discussed above is intended to provide an example of a suitable configuration for footwear 10 and other applications. In other configurations of footwear 10 or in other applications, various aspects of chamber 33 may vary considerably. For example, the overall shape of chamber 33 may vary depending upon the areas of footwear 10 in which chamber 33 is intended to be located. Referring to FIG. 10A, chamber 33 has a generally round configuration that may be located within heel region 13 and entirely embedded within the polymer foam of midsole element 31, for example. Another shape is depicted in FIG. 10B, wherein chamber 33 has a configuration that extends through both heel region 13 and midfoot region 12. In this configuration chamber 33 may replace midsole element 31 such that chamber 33 extends from lateral side 14 to medial side 15 and from upper 20 to outsole 32. A similar configuration is depicted in FIG. 100, wherein chamber 33 has a shape that fits within a perimeter of sole structure 30 and extends under substantially all of the foot, thereby corresponding with a general outline of the foot. In this configuration chamber 33 may also replace midsole element 31 such that chamber 33 extends from lateral side 14 to medial side 15, from heel region 13 to forefoot region 11, and from upper 20 to outsole 32.

Figure 11A:
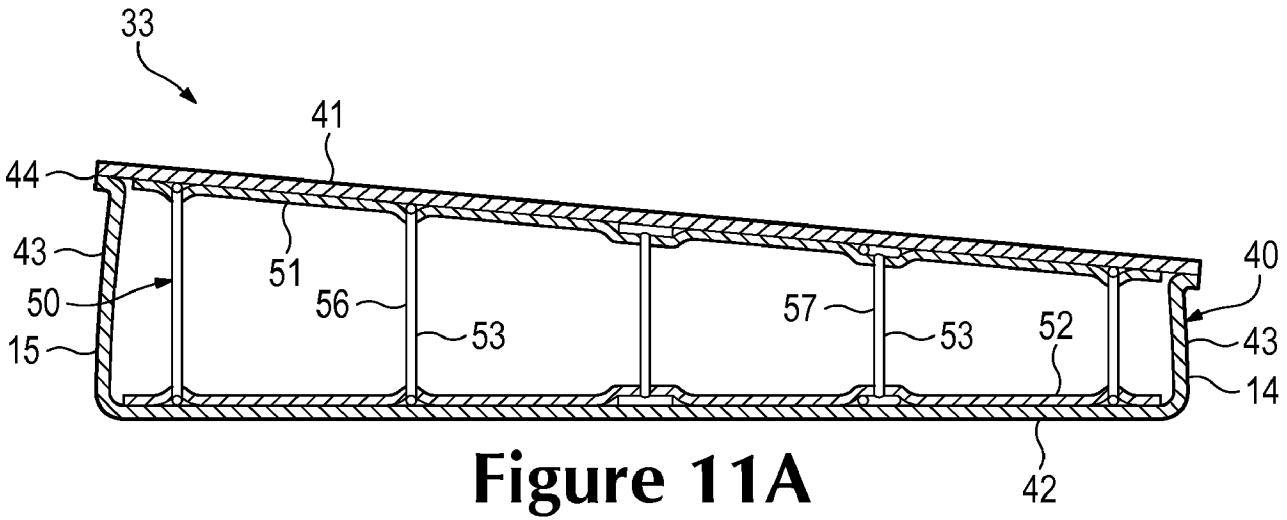
FIGS. 11A-11H are cross-sectional views corresponding with FIG. 8B and depicting further configurations of the chamber.

Although the structure of chamber 33 discussed above and depicted in the figures provides a suitable example of a configuration that may be utilized in footwear 10, a variety of other configurations may also be utilized. Referring to FIG. 11A, chamber 33 exhibits a tapered configuration. One manner of imparting the tapered configuration relates to the relative lengths of tether elements 53. Whereas tether elements 53 are relatively long in the areas of chamber 33 exhibiting greater thicknesses, tether elements 53 are relatively short in the areas of chamber 33 exhibiting lesser thicknesses. More particularly, the tether elements 53 in FIG. 11A include a first tether element 56 and a second tether element 57. First tether element 56 has a greater length than second tether element 57. In general, the thickness of chamber 33 may be defined as the distance between the upper and lower surfaces of chamber 33 (i.e., the surfaces defined by barrier portions 41 and 42). In this configuration, chamber 33 has (a) a first thickness in an area of first tether element 56 and (b) a second thickness in an area of the second tether element 57, the first thickness being greater than the second thickness due to the difference in length between tether elements 56 and 57. By varying the lengths of tether elements 53, therefore, tapers or other contour-type features may be incorporated into chamber 33.

Figure 10C:
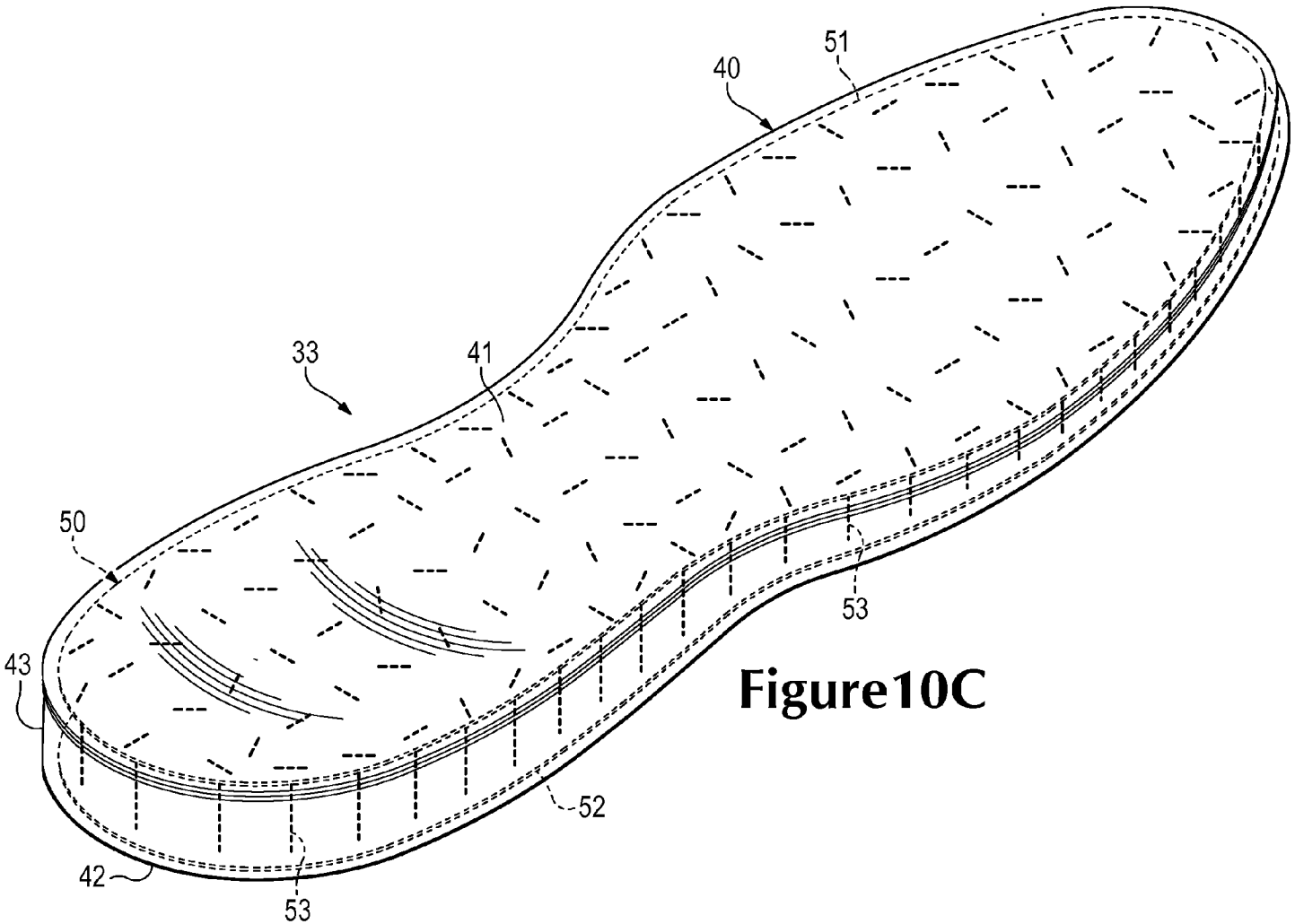
Figure 11B:
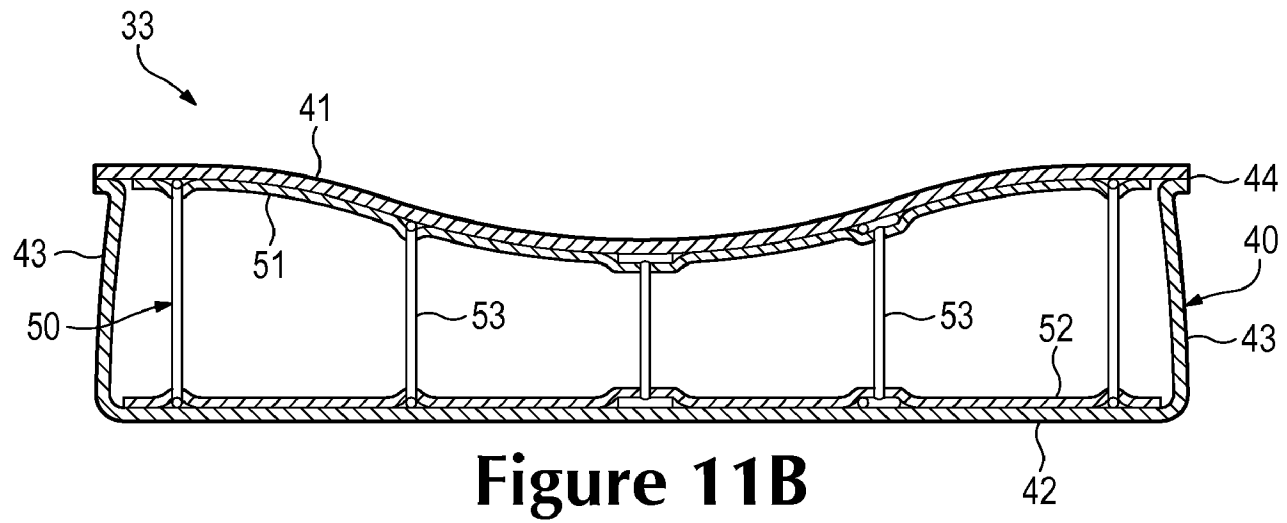

The taper in FIG. 11A extends from lateral side 14 to medial side 15. A taper may also extend from heel region 13 to forefoot region 12, as in the configuration of chamber 33 depicted in FIG. 10C. Another configuration of chamber 33 is depicted in FIG. 11B, wherein a central area of chamber 33 is depressed relative to the peripheral areas. More particularly, tether elements 53 with greater length are positioned peripherally, and tether elements 53 with lesser length are positioned centrally, thereby forming a depression in the central area of chamber 33. When incorporated into footwear 10, the depression may correspond with the location of the heel of the wearer, thereby providing an area for securely-receiving the heel. A similar depression is also formed in the configuration of chamber 33 depicted in FIG. 10C. In other configurations, upper layer element 51 may be contoured to form a protruding arch support area, for example.

Figure 11C:
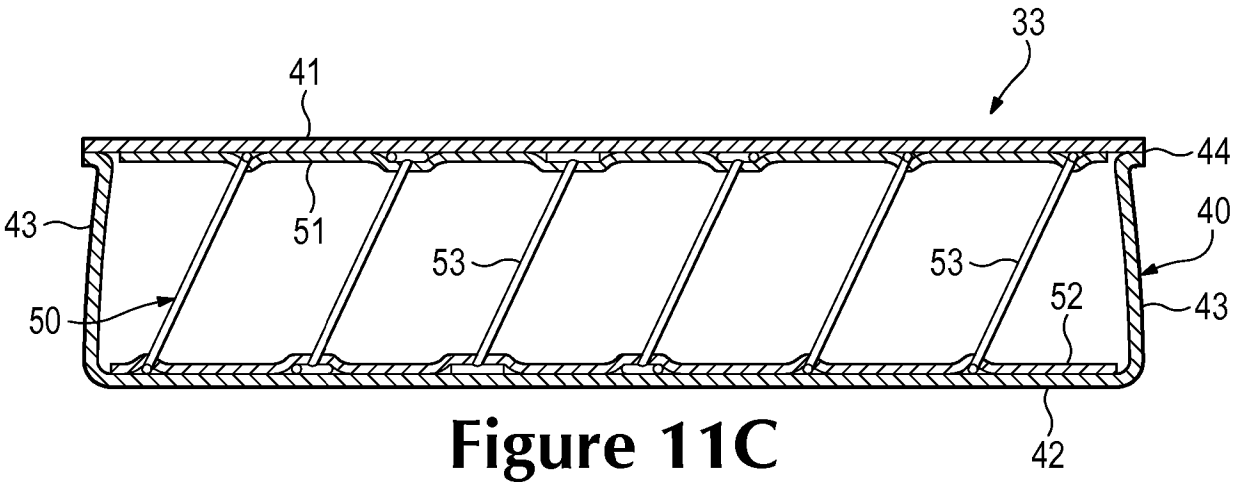
Figure 11D:
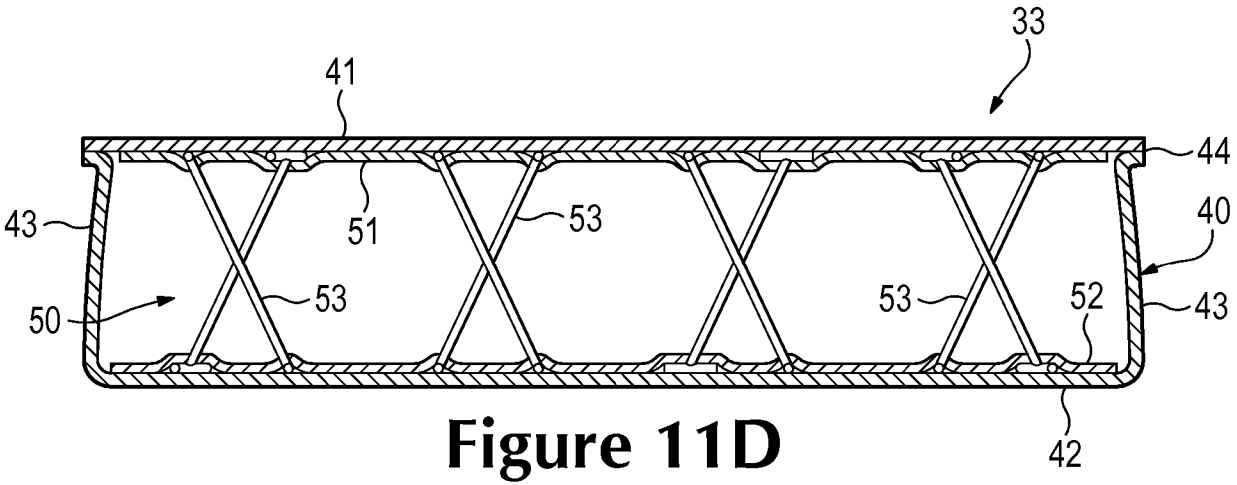

Various aspects relating to tether elements 53 may also vary. Referring to FIG. 11C, each of tether elements 53 exhibit a diagonal orientation. In some configurations, tether elements 53 may cross each other to form x-shaped structures with opposing diagonal orientations, as depicted in FIG. 11D. In both of these configurations, tether elements 53 are secured to offset areas of layer elements 51 and 52 in order to induce the diagonal orientation. An advantage of the diagonal orientation of tether elements 53 relates to the stability of chamber 33 during cutting motions that induce shear stresses in chamber 33 10. Cutting motions are often utilized in many athletic activities to move an individual side-to-side. Accordingly, the diagonal orientation of tether elements 53 may resist deformation in chamber 33 due to shear stresses (e.g., from cutting motions), thereby enhancing the overall stability of footwear 10 during walking, running, or other ambulatory activities.

Figure 11E:
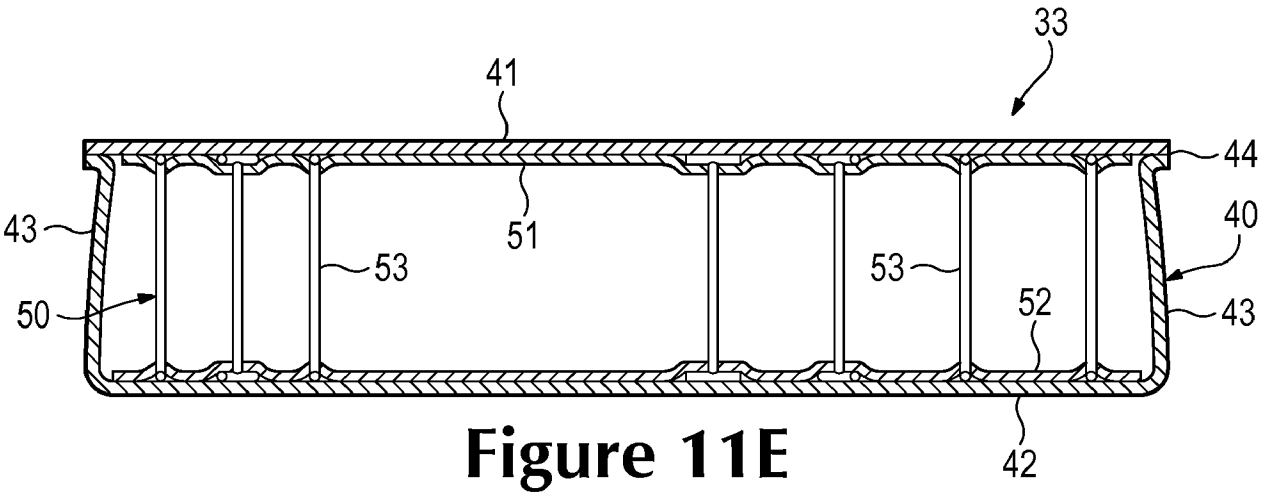
Figure 11F:
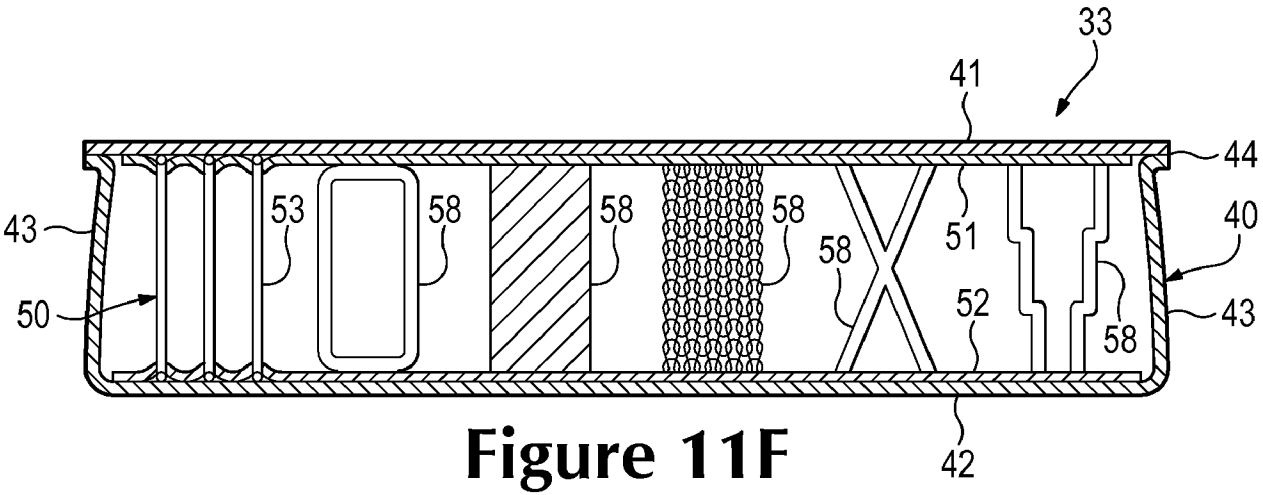

The spacing between adjacent tether elements 53 may also vary significantly, as depicted in FIG. 11E, and tether elements 53 may be absent from some areas of chamber 33. While tether elements 53 may be solely used within tensile member 50, a variety of other materials or structures may be located between layer elements 51 and 52 to prevent barrier 40 from expanding outward and retain the intended shape of chamber 33. Referring to FIG. 11F, for example, a variety of other tethers 58 are located between plates 51 and 51. More particularly, tethers 58 may be a fluid-filled member, a foam member, a textile member, an x-shaped member, or a telescoping member. Accordingly, a variety of other materials or structures may be utilized with tether elements 53 or in place of tether elements 53.

Figure 11G:
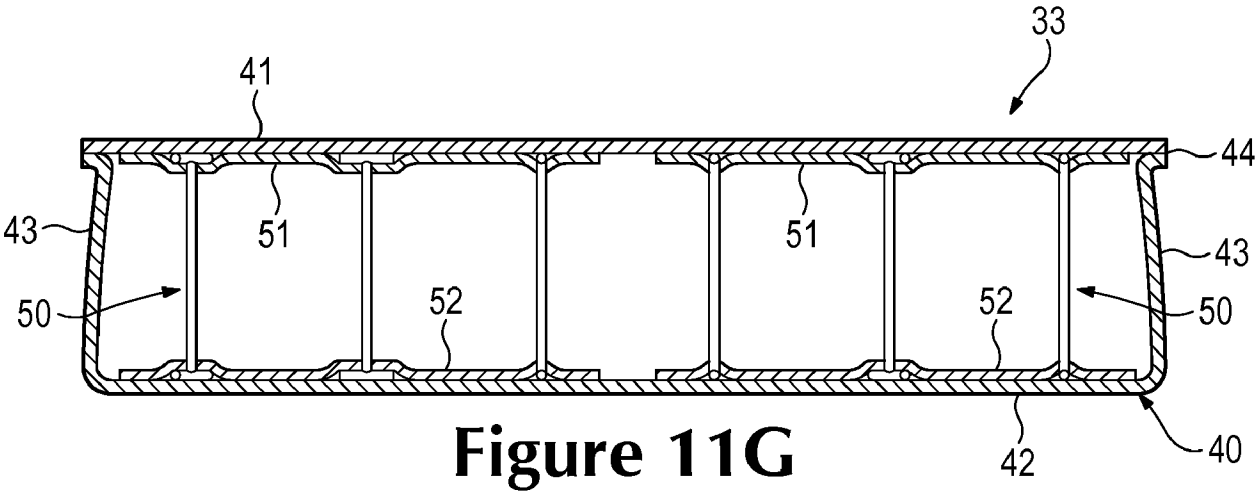
Figure 11H:
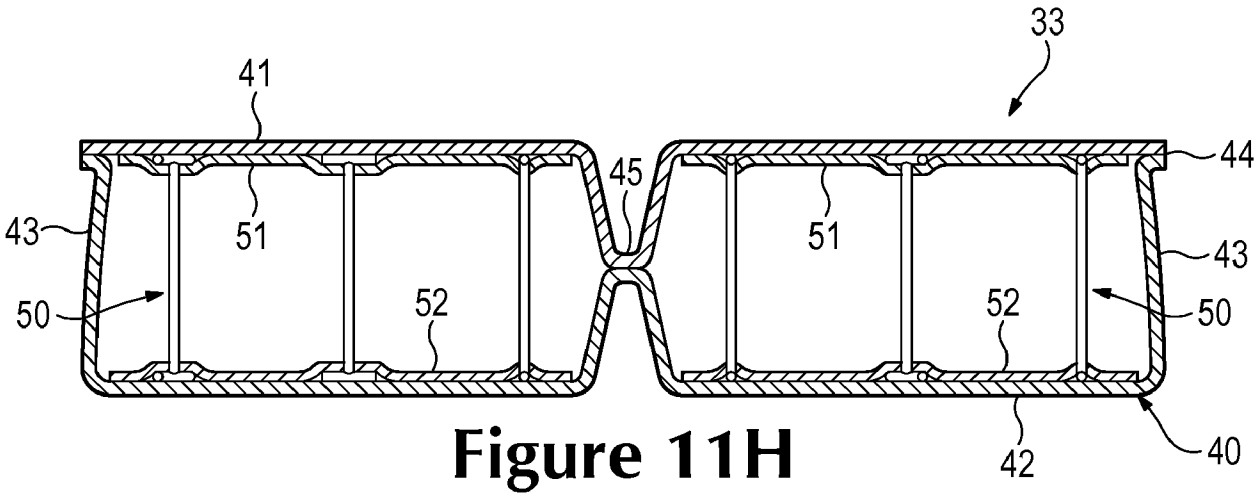

Although a single upper layer element 51 and a single lower layer element 52 may be utilized in chamber 33, some configurations may incorporate multiple layer elements 51 and 52. Referring to FIG. 11G, two upper layer elements 51 and two lower layer elements 52 are located within the interior cavity of barrier 40. An advantage to this configuration is that each of layer elements 51 may deflect independently when compressed by the foot. A similar configuration is depicted in FIG. 11H, wherein a central bond 45 joins barrier portions 41 and 42 in the central area of chamber 33. Bond 45 may, for example, form separate subchambers within chamber 33, which may be pressurized differently to affect the compressibility of different areas of chamber 33. As an additional matter, each of layer elements 51 and 52 may be formed from different materials to impart different properties to various areas of chamber 33.

Figure 12:
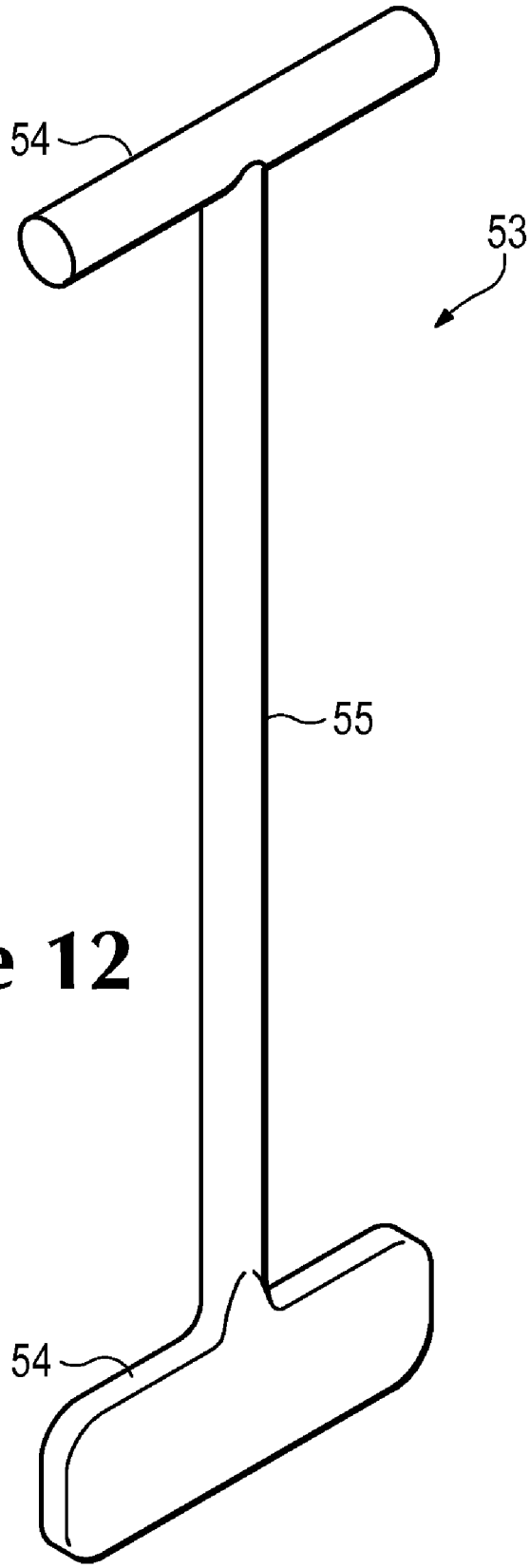
FIG. 12 is a perspective view depicting a further configuration of the tether element.

The overall configuration of tether elements 53 may also vary considerably. Referring to FIG. 12, one of tether elements 53 is depicted as having a generally flat or planar end member 54. More particularly, one of end members 54 and central member 55 each have a cylindrical structure, but the other one of end members 54 has the generally flat or planar configuration. A variety of other shapes or configurations may also be utilized for tether elements 53. In some configurations, tether elements 53 may be formed from a thermoplastic polymer material that bonds with barrier 40.

Manufacturing Process

In manufacturing chamber 33, a pair of polymer sheets may be molded and bonded during a thermoforming process to define barrier portions 41-43. More particularly, the thermoforming process (a) imparts shape to one of the polymer sheets in order to form upper barrier portion 41, (b) imparts shape to the other of the polymer sheets in order to form lower barrier portion 42 and sidewall barrier portion 43, and (c) forms a peripheral bond 44 that joins a periphery of the polymer sheets and extends around an upper area of sidewall barrier portion 43. The thermoforming process may also locate tensile member 50 within chamber 33 and bond tensile member 50 to each of barrier portions 41 and 42. In general, therefore, a thermoforming process similar to a thermoforming process disclosed in U.S. Pat. No. 6,837,951 to Rapaport, which is entirely incorporated herein by reference, may be utilized to manufacture chamber 33. Although substantially all of the thermoforming process may be performed with a mold, each of the various parts of the process may be performed separately in forming chamber 33. Other processes that utilize blowmolding, rotational molding, or the bonding of polymer sheets without thermoforming may also be utilized to manufacture chamber 33.

Following the thermoforming process, a fluid may be injected into the interior cavity and pressurized. The pressurized fluid exerts an outward force upon barrier 40 and layer elements 51 and 52, which tends to separate barrier portions 41 and 42. Tensile member 50, however, is secured to each of barrier portions 41 and 42 in order to retain the intended shape of chamber 33 when pressurized. More particularly, tether elements 53 extend across the interior cavity and are placed in tension by the outward force of the pressurized fluid upon barrier 40, thereby preventing barrier 40 from expanding outward and retaining the intended shape of chamber 33. Whereas peripheral bond 44 joins the polymer sheets to form a seal that prevents the fluid from escaping, tensile member 50 prevents chamber 33 from expanding outward or otherwise distending due to the pressure of the fluid. That is, tensile member 50 effectively limits the expansion of chamber 33 to retain an intended shape of surfaces of barrier portions 41 and 42.

As noted above, tether elements 53 may have the configuration of a hang tag that is utilized to join price tags and other information to apparel and other products in a retail environment. An advantage of this configuration relates to the process that may be utilized to form tensile member 50. In general, layer elements 51 and 52 may be placed in contact with each other (i.e., in an overlapping configuration). A conventional hang tag securing device (i.e., clothing tag guns, label tag guns, or just tag guns) may then be utilized to pierce layer elements 51 and 52 with one of tether elements 53 such that (a) end members 54 are located on opposite sides of layer elements 51 and 52 and (b) central member 55 extends through layer elements 51 and 52. This process may then be repeated until multiple tether elements 53 pierce layer elements 51 and 52. Alternately, an array of hang tag securing devices may be utilized to simultaneously pierce layer elements 51 and 52 with multiple tether elements 53, thereby quickly forming one of tensile members 50. Moreover, the individual securing devices in the array of hang tag securing devices may each have different lengths of tether elements 53 to form a contoured aspect to chamber 33. Layer elements 51 and 52 may then be separated such that end members 54 lay against outward facing surfaces of layer elements 51 and 52 to effectively complete the manufacture of tensile member 50.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A chamber comprising:

an outer barrier formed from a polymer material that is sealed to define an interior cavity for enclosing a pressurized fluid; and a tensile member located within the interior cavity, the tensile member including a plurality of I-shaped tether elements that extend across the cavity;

wherein the tether elements include a first tether element and a second tether element, the first tether element having a greater length than the second tether element.

2. The chamber recited in claim 1, wherein the tensile member further includes a pair of layer elements secured to the outer barrier and located on opposite sides of the interior cavity, each of the tether elements extending through both of the layer elements.

3. The chamber recited in claim 1, wherein each of the layer elements are at least one of a textile and a polymer sheet.

4. The chamber recited in claim 1, wherein each of the tether elements include a pair of end members and a central member, ends of the central member being joined with the end members.

5. The chamber recited in claim 4, wherein the tensile member further includes a pair of layer elements secured to the outer barrier and located on opposite sides of the interior cavity, the end members being located between the layer elements and outer barrier.

6. The chamber recited in claim 1, wherein a central area of the chamber is depressed relative to peripheral areas of the chamber.

7. The chamber recited in claim 1, wherein the chamber has (a) a first thickness in an area of the first tether element and (b) a second thickness in an area of the second tether element, the first thickness being greater than the second thickness.

8. An article of footwear incorporating the chamber recited in claim 1.

9. An article of footwear having an upper and a sole structure secured to the upper, at least one of the upper and the sole structure incorporating a chamber comprising:

an outer barrier formed from a polymer material that defines an interior cavity, the outer barrier including (a) a first barrier portion that forms a first surface of the chamber and (b) a second barrier portion that forms an opposite second surface of the chamber; and a tensile member located within the interior cavity of the outer barrier, the tensile member including (a) a first layer element secured to the first barrier portion of the outer barrier, (b) a second layer element secured to the second barrier portion of the outer barrier, and (c) a plurality of I-shaped tether elements that extend through the first layer element and the second layer element.

10. The article of footwear recited in claim 9, wherein a fluid is located within the interior cavity, the fluid being pressurized to place an outward force upon the barrier and induce tension in the tether elements.

11. The article of footwear recited in claim 9, wherein each of the tether elements include (a) a first end member, (b) a second end member, and (c) a central member that extends between the first end member and the second end member, the first end member being located between the first barrier portion and the first layer element, and the second end member being located between the second barrier portion and the second layer element.

12. The article of footwear recited in claim 11, wherein the first end member has a cylindrical configuration and the second end member has a planar configuration.

13. The article of footwear recited in claim 9, wherein the tether elements include a first tether element and a second tether element, the first tether element having a greater length than the second tether element.

14. The article of footwear recited in claim 13, wherein the chamber has (a) a first thickness defined as a distance between the first surface and the second surface of the chamber in an area of the first tether element and (b) a second thickness defined as a distance between the first surface and the second surface of the chamber in an area of the second tether element, the first thickness being greater than the second thickness.

15. The article of footwear recited in claim 9, wherein the first layer element and the second layer element are at least one of a textile and a polymer sheet.

16. An article of footwear having an upper and a sole structure secured to the upper, at least one of the upper and the sole structure incorporating a chamber comprising:

an outer barrier formed from a polymer material that defines an interior cavity, the barrier including (a) a first barrier portion that forms a first surface of the chamber, and (b) a second barrier portion that forms an opposite second surface of the chamber; and a tensile member located within the interior cavity of the outer barrier, the tensile member including (a) a first layer element secured to the first barrier portion of the outer barrier, (b) a second layer element secured to the second barrier portion of the outer barrier, and (c) a plurality of tether elements that include (a) a first end member located between the first barrier portion and the first layer element, (b) a second end member located between the second barrier portion and the second layer element, and (c) a central member extending through the first layer element and the second layer element and secured to the first end member and the second end member.

17. The article of footwear recited in claim 16, wherein a fluid is located within the interior cavity, the fluid being pressurized to place an outward force upon the barrier and induce tension in the tether elements.

18. The article of footwear recited in claim 16, wherein the tether elements include a first tether element and a second tether element, the first tether element having a greater length than the second tether element.

19. The article of footwear recited in claim 18, wherein the chamber has (a) a first thickness in an area of the first tether element and (b) a second thickness in an area of the second tether element, the first thickness being greater than the second thickness.

20. The article of footwear recited in claim 18, wherein the first layer element and the second layer element are at least one of a textile and a polymer sheet.

21. An article of footwear having an upper and a sole structure secured to the upper, at least one of the upper and the sole structure incorporating a chamber comprising:

an outer barrier formed from a polymer material that defines an interior cavity, the barrier including (a) a first barrier portion that forms a first surface of the chamber, and (b) a second barrier portion that forms an opposite second surface of the chamber; and a tensile member located within the interior cavity of the outer barrier, the tensile member including (a) a first layer element secured to the first barrier portion of the outer barrier, (b) a second layer element secured to the second barrier portion of the outer barrier, and (c) a first tether element and a second tether element each having an I-shaped configuration, the first tether element having a greater length than the second tether element.

22. The article of footwear recited in claim 21, wherein the chamber has (a) a first thickness in an area of the first tether element and (b) a second thickness in an area of the second tether element, the first thickness being greater than the second thickness.

23. The article of footwear recited in claim 21, wherein a fluid is located within the interior cavity, the fluid being pressurized to place an outward force upon the barrier and induce tension in the first tether element and the second tether element.

24. The article of footwear recited in claim 21, wherein the first tether element includes (a) a first end member located between the first barrier portion and the first layer element, (b) a second end member located between the second barrier portion and the second layer element, and (c) a central member that is joined to the first end member and the second end member and extends through the first layer element and the second layer element.

25. The article of footwear recited in claim 21, wherein the first layer element and the second layer element are at least one of a textile and a polymer sheet.

* * * * *